US006650223B1

(12) United States Patent
Jöllenbeck et al.

(10) Patent No.: US 6,650,223 B1
(45) Date of Patent: Nov. 18, 2003

(54) ELECTRICAL FUSE ELEMENT

(75) Inventors: André Jöllenbeck, Bochum (DE); Barbara Marzinkowski, Witten (DE); Peter Pössnicker, Witten (DE)

(73) Assignee: Wickmann-Werke GmbH (DE)

( * ) Notice: Subject to any disclaimer, the term of this patent is extended or adjusted under 35 U.S.C. 154(b) by 0 days.

(21) Appl. No.: 09/674,013

(22) PCT Filed: Apr. 23, 1999

(86) PCT No.: PCT/EP99/02739

§ 371 (c)(1),
(2), (4) Date: Oct. 24, 2000

(87) PCT Pub. No.: WO99/56297

PCT Pub. Date: Nov. 4, 1999

(30) Foreign Application Priority Data

Apr. 24, 1998 (DE) ..... 198 18 523
Jun. 20, 1998 (DE) ..... 198 27 595

(51) Int. Cl.[7] ..... H01H 85/055; H01H 69/02

(52) U.S. Cl. ..... 337/297; 337/227; 337/159; 337/290; 29/623

(58) Field of Search ..... 337/297, 161–166, 337/290, 159, 186, 227, 228; 29/623

(56) References Cited

U.S. PATENT DOCUMENTS 1,889,585 A * 11/1932 Zodrow et al. ..... 337/273
3,197,593 A 7/1965 Lange et al.
3,267,240 A * 8/1966 Fitz Gerald ..... 337/296
4,057,774 A * 11/1977 Arikawa et al. ..... 337/164
4,189,696 A * 2/1980 Beswick et al. ..... 337/232
4,409,729 A * 10/1983 Shah ..... 29/623
4,445,106 A 4/1984 Shah
4,517,544 A * 5/1985 Spaunhorst ..... 337/164
4,560,971 A * 12/1985 Oh ..... 337/164
4,680,567 A * 7/1987 Edwards ..... 337/164
4,736,180 A * 4/1988 Oh ..... 337/163
5,142,262 A * 8/1992 Onken ..... 29/623
5,235,307 A * 8/1993 Oh ..... 337/228

FOREIGN PATENT DOCUMENTS

| | | |
|---|---|---|
| DE | 29616063 | 10/1996 |
| DE | 29706366 | 11/1997 |
| FR | 2638566 | 5/1990 |
| GB | 2248734 | 4/1992 |
| WO | 96/08832 | 3/1996 |
| WO | 96/41359 | 12/1996 |

* cited by examiner

*Primary Examiner*—Anatoly Vortman
(74) *Attorney, Agent, or Firm*—Banner & Witcoff, Ltd.

(57) ABSTRACT

The present invention relates to an electrical fuse element having an essentially ceramic housing which, in the unfired state, is closed around at least one fusible conductor. To improve the properties of such a fuse element with respect to the extremely high internal pressures occurring during switching off as well as when exposed to an arc, a fuse element (5) in which the fusible conductor (1) has an electrically conducting component, in particular a metallic wire (2), and an insulating, porous component is proposed.

15 Claims, 2 Drawing Sheets

ELECTRICAL FUSE ELEMENT

The present invention relates to an electrical fuse element having an essentially ceramic housing which, in the unfired state, is closed around at least one fusible conductor.

Such electrical fuse elements are also referred to as chip fuse elements and designed as surface-mountable devices. Fuse elements of the said type are known, for example, from WO 96/08832. This document discloses a method of producing electrical fuse elements in which fusible conductors are hermetically enclosed in a pressing step between at least one upper ceramic layer and at least one prepared, lower unfired ceramic layer. After dividing up into individual fusible conductor portions, with surrounding housing, this method provides a sintering step and the attachment of external contacts to the end regions of the fusible conductor portions. With the fuse elements produced according to this method of production, it has proved to be disadvantageous in particular that the ceramic housing of the fuse element is exposed to such extremely high internal pressures at the switching-off instant, caused by evaporating fusible conductor material, or in the plasma of an arc, that it can break open.

U.S. Pat. No. 3,197,596 discloses an electric safety fuse component comprising a fusible metallic conductor and non-metallic material where the metallic conductor is directly in fixed connection with a predetermined volume of the non-metallic material. Using fine milled sand as non-metallic material the electric safety fuse component according to U.S. Pat. No. 3,197,596 is used to avoid damage of the housing of the fuse.

It is the object of the present invention to develop a fuse element of the generic type avoiding the aforesaid problems and having reliable electrical contacts ensuring a gas tight manner of the housing as well. It is a further object that the new fuse element allows a cost reducing way of production.

There is therefore the object of developing a fuse element of the generic type in a simple way in terms of production engineering, while avoiding the disadvantages described above.

This object is achieved according to the invention by the fusible conductor having an electrically conducting component, in particular a metallic wire, and an insulating, porous component, and at least one hole in a ceramic layer is located in the region of the fusible conductor and, to form an external contact, the said hole is filled with a conductive paste capable of cofiring and, after a sintering step, forms an electrical connection to the fusible conductor.

A fuse element according to the invention utilizes in its production the property of green, unfired ceramic layers adhesively bonding together and thereby enclosing a fusible conductor in a hermetically sealed manner. Without an additional mechanical treatment of the material, it is consequently scarcely possible to provide closed-off pressure-equalizing chambers with defined properties. This applies in particular since, in known methods of production, a pressing step is preferably used for the reliable adhesive bonding of green ceramic layers arranged one on top of the other. Among the presses used for this purpose are isostatic presses or conventional presses with especially profiled pressing plates, which bring about an intimate bond between the ceramic layers to increase the resistance of the housings to internal pressure.

Irrespective of how the pressing is carried out, it is proposed according to the invention to use a fusible conductor comprising two components, one electrically conducting, the other insulating. The insulating component is in this case porous. To comply with the customary forms in which electrical fuse elements are made, this porous component may be of an elongated design. The fusible conductor is consequently made porous by one of its components and absorbs metallic vapours and excess pressure itself during switching off. If a fusible conductor of the type described above is used and pressing between two unfired, green ceramic layers is carried out, this fusible conductor too is further enclosed in a hermetically sealed manner on its outside. Tests have confirmed, however, that the property of a defined porosity in the component of the fusible conductor material is not lost as a result of the pressing with the ceramic layers. Therefore, an exactly determinable porosity for the absorption of metallic vapours can be provided in a simple way by the material. These voids are in this case preferably located in the direct vicinity of the electrically conducting fusible conductor material to be melted.

If fusible conductor elements of relatively large diameters are used, the enclosing with two green ceramic layers has the effect of making the later ceramic housing convex. Excessive elevation in she region of the fusible conductor of a laminate structure formed by two green ceramic layers can be prevented in particular by the fusible conductor being pressed at least partially into a first green ceramic layer when it is laid onto the latter. If an isostatic press or a press having at least one profiled press plate is used, the elevation around the fusible conductor can be reduced without adverse effects on the stability of the ceramic housing. By this measure, or else by applying in parallel to the fusible conductor strips of green ceramic running on a second, covering green ceramic layer, the surfaces of the ceramic housing can be shaped in such a way that it can also be mounted in SMD processes and in particular not have any preferred mounting surfaces.

According to claim 2, the insulating component is preferably fibrous and comprises in particular filaments of one or more electrically insulating substances. All materials which have a good electrically insulating effect without the risk of conductive carbon bridges forming under long-term heating or as a result of ageing can in principle be selected for the use according to the invention. Compared with other materials of comparable insulating effect, a porous ceramic material is, however, distinguished in particular by the fact that it offers many voids for the absorption of metallic vapours even at the high temperatures at the switching instant. However, the insulating component preferably comprises ceramic filaments, since a ceramic fibrous material with a large surface area draws considerable thermal energy from an arc on account of its extremely high melting point. Furthermore, the chambers formed for example between the filaments or else in a ceramic paper serve at the switching instant as an excess pressure damping means in the otherwise pressure-tight, closed housing.

In a development of the invention, the fusible conductor comprises a core and a sheath. According to claim 5, the core can be formed by ceramic filaments. The sheath consists of an electrically conductive material. In a preferred embodiment, the insulating component forms a particularly elongated core, around which the wire is wound. The fusible conductor can consequently have overall the form of a wound fusible conductor, produced according to known methods, as is used for example in the area of glass-enclosed fuses or miniature fuses. Consequently, the effective length of the fusible conductor is also advantageously increased, so that the fuse element according to the invention can be used over a large range of current steps. The production engineering problems occurring in the production of such a wound fusible conductor when producing to a high degree of accuracy and maintaining predetermined fusible conductor characteristics have accordingly long been known and solved. The ceramic filaments hence assume a multiple function in a use according to the invention. On the one hand, they serve in the production of the wound fusible conductor as a support for the thin fusible conductor wire and define the diameter of the wire coil, on the other hand they assume the task of a quenching medium within the finished fuse and consequently act in a similar way to that known, for example, from a sand filling in the case of glass-enclosed fuses. Unlike in the case of the glass-enclosed fuse, the ceramic filaments are, however, arranged inside the actual fusible conductor and consequently cannot have any adverse effect on the switching-off characteristics of the fuse element on account of thermal conduction to the outer housing of the fuse element.

In an alternative embodiment, the wire is embedded in the insulating component, in particular is surrounded by the filaments in a tubular manner. Consequently, a smooth wire which is surrounded by thermally insulating filaments, in particular only in the region of the hot spot of the fusible link, that is to say in a defined portion, can also be used advantageously. Outside this region, the probability of the fuse being triggered is extremely low, so that the wire fusible conductor may be enclosed here in a gas-tight manner by the ceramic material. In this way, a reliably sealed electrical fuse can be produced in a simple way.

According to claim 7, the filaments are advantageously twisted together, interwoven or connected to one another in some other way, in particular flexibly. For instance, sheath portions can also be produced during production and can be pushed individually over a fusible conductor or a portion of the fusible conductor. In this respect it is known, for example, from fibres twisted in a sheath-like manner that, by compressing a portion, they can be influenced in such a way that the opening of the sheath is widened while the portion is at the same time shortened. Ceramic filaments are also flexible in an adequate range, so that they can be processed for example like glass fibres or similar insulating material fibres. A compressing of the portion can considerably facilitate the insertion of a fusible wire for constructing a fuse element according to the invention, that is to say also when using ceramic fibres. By stretching, the sheath then encloses the conductor very tightly, it preferably being possible for the stretching to be brought about automatically at the same time as the pressing of the arrangement.

Further fusible conductor is arranged between a base layer and a perforated covering layer in such a way that at least one hole in a ceramic layer is located in the region of the fusible conductor. To form an external contact, the hole is filled with a conductive paste capable of cofiring. After a sintering step, an electrical connection is formed from the outer surface of the ceramic housing to the fusible conductor. In this respect, the conductive paste, for example in the form of a resinate paste or a metallic ink, also serves at the same time for sealing or closing the still unfired ceramic housing, which is otherwise already hermetically sealed after the pressing. Consequently, completely formed, solderable external contacts have already been produced after the sintering step in very few production steps using known pastes.

In an advantageous development, according to claim 8, a hole in a ceramic covering layer and a hole in a ceramic base layer are arranged lying one above the other in the region of the longitudinal axis of the fusible conductor for the purpose of forming an external contact. As a result, external contacts of in principle the same type are created in the region of the covering layer and in the region of the base layer. The fuse element can consequently be electrically contacted in more than just one position, for example by soldering, and also fixed in its position.

On the ceramic covering layer and/or the ceramic base layer in the region of the hole there is advantageously a strip of a conductive paste, capable of cofiring, arranged on the unfired material essentially perpendicularly with respect to the axis of the fusible conductor. During pressing of the arrangement and the subsequent sintering step, an electrically conductive contact area from the fusible conductor to the respective external contact is formed by the strip. The terminal area has the effect in particular of narrowing the current density distribution virtually constantly from the external contact to the fusible conductor. This produces regions with a high current density and ideal thermal preconditions only deep inside the closed ceramic housing. After the sintering step, the housing is also hermetically sealed and, by virtue of the ceramic, is particularly stable mechanically. In this housing region, the temperatures necessary for the switching off of a fuse element according to the invention are accordingly also achieved. This region is generally referred to as the "hot spot". While realizing the features mentioned above, the hot spot is reliably displaced into a central region of the ceramic fuse body, so that even the high internal pressures occurring during switching off can be reliably absorbed in every case by the housing.

In a preferred embodiment, the holes in the ceramic covering layer and the ceramic base layer are made as plated-through holes, the corresponding through holes preferably being made in the unfired arrangement after pressing, for example by punching. When using a press with profiled plates, this punching step may also be performed at the same time as the pressing.

The length of a fusible element according to the invention is advantageously fixed by the distance between the holes in the axial direction of the fusible conductor. The freely selectable length can consequently be used to have a significant influence also on the properties of the fuse. Furthermore, by fixing this length, a fuse element according to the invention can be adapted to predetermined outer housing dimensions, taking into consideration the material shrinkage during sintering.

In a particularly advantageous development, a glass-ceramic material or some other material with a very low thermal conductivity in the sintered state is used as the unfired ceramic material of the covering layer and/or the base layer. Choosing such a material has the preferable effect of concentrating the hot spot in the centre of an electrical fuse element according to the invention, a comparatively low heat dissipation occurring via the housing.

The ceramic covering layer and/or the base layer preferably consist of green ceramic material in the form of endless strips and/or sheets which have, in particular, commercially customary dimensions. By this type of material preselection, the production of fuse elements according to the invention can be carried out in a continuous production process as multiple repeats in the form of a long strip, in particular realizing the features of claim 1 and/or claim 3. Downtimes caused for process engineering reasons are minimized to an extreme in this way, so that a very efficient method of production is brought about by the design according to the invention of the electrical fuse element described, together with production in the form of a strip and integrated construction of the later end contacts. An individual separation of the fuse elements can in this case be carried out, in particular even only after the sintering step, for example by breaking along an axis perpendicularly with respect to the longitudinal axis of the fuse element through the hole with the contacting sintered coating. Consequently, there is advantageously no need for any subsequent treatment even in the region of the separating or breaking edges of a fuse element according to the invention.

Further advantages of the invention are explained in more detail below with reference to two exemplary embodiments on the basis of the drawing, in which.

Figure 1:
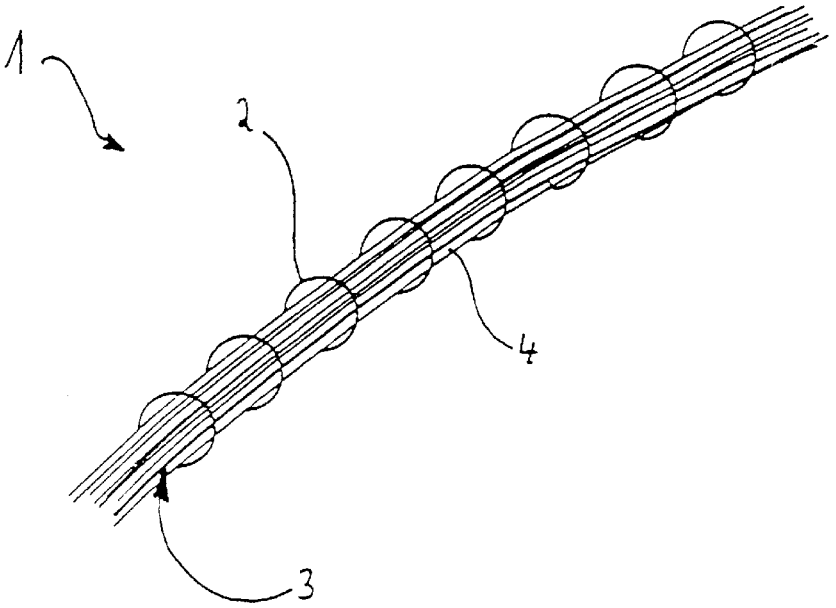
FIG. 1 shows a fusible conductor in a diagrammatic representation.

FIG. 1 shows as a three-dimensional diagram the basic construction of a fusible conductor 1, as it is used in an electrical fuse element according to the present invention. The fusible conductor 1 comprises a wire 2, which is wound around a core 3, with the number of times it is wound around per unit length of the core 3 being precisely fixed. The core 3 itself comprises ceramic filaments 4, which have voids between the individual filaments 4 even if the wire 2 is wound extremely tightly around the core 3. Depending on how the process for producing the ceramic filaments 4 is conducted, a core 3 which has a definite predeterminable porosity on account of the voids between the filaments can be produced. In this respect, the ceramic material of the filaments 4 is distinguished by two particular properties, namely good electrical insulation and high thermal resistance. The insulating properties of the ceramic are in this case generally not subjected to any adverse ageing influences. The high thermal stability has the effect that the filaments 4 are at least partially resistant, even in the region of a switch arc during triggering of the fuse element and, accordingly, the vaporizing of the wire 2 while forming an arc, so that the metallic vapours can be absorbed and trapped between the filaments 4 and, moreover, the voids can serve as pressure-equalizing buffers.

Figure 2:
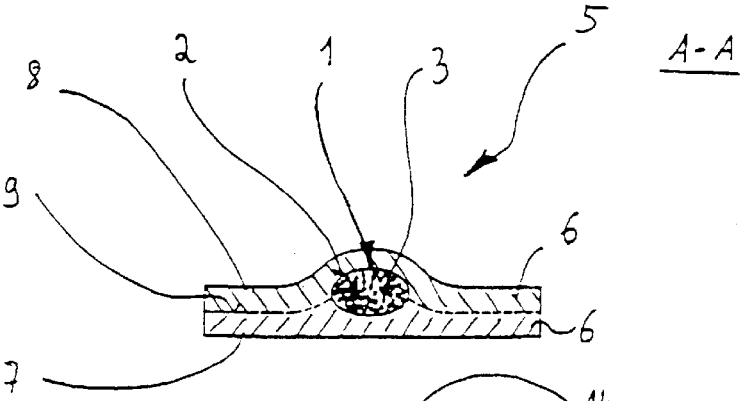
FIG. 2 shows a section through a fuse element according to the invention.

FIG. 2 shows a section perpendicularly through a preferred embodiment of an electrical fuse element 5 in a plane A—A (see FIG. 3) perpendicular with respect to the axis of the fusible conductor 1. The wire 2 of the fusible conductor 1, wound on the core 3, is outwardly surrounded in a hermetically sealing manner by two ceramic layers 6, a base layer 7 and a covering layer 8. In a preferred method of production, the fusible conductor 1 is already partially pressed into the base layer 7 before it is covered, at least in the region of its hot spot, by the covering layer 8. This allows the effect to be achieved that no excessive elevation in the laminate structure comprising the two ceramic layers 6 occurs even in the region of the fusible conductor 1.

Using an isostatic press, the covering layer 8 is pressed in a sealing manner around the fusible conductor 1, so that even a limiting plane 9 between the ceramic layers 8 no longer exists after pressing. It is therefore represented in FIG. 2 only in the form of a dashed line. After pressing, the ceramic layers 6 already form around the fusible conductor 1 a hermetically sealing housing which is mechanically greatly stabilized by a subsequent sintering step and can undergo considerable loading even by high internal pressures.

Figure 3:
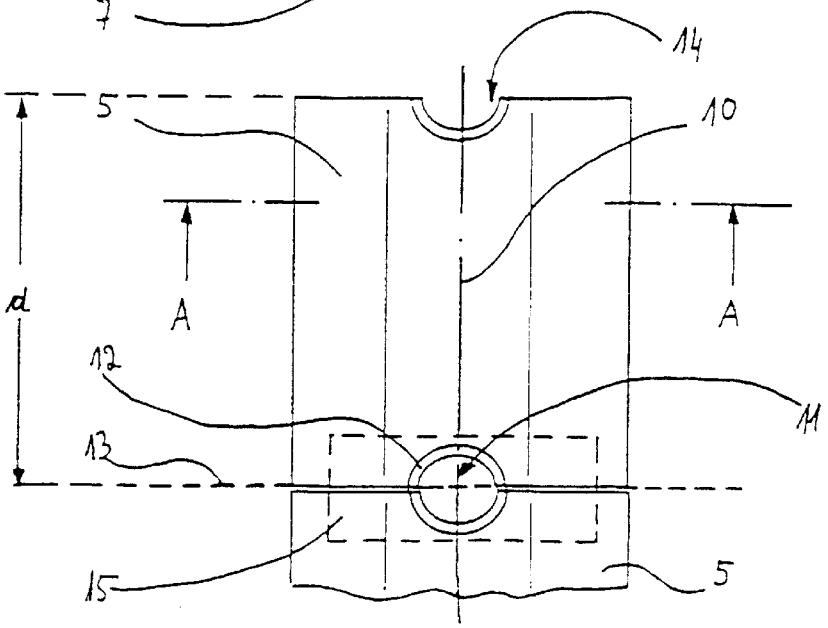
FIG. 3 shows a plan view of a fully sintered fuse element.

A plan view of a preferred embodiment of an electrical fuse element 5 is diagrammatically shown in FIG. 3 during the final step of a method of production. In FIG. 3, a sectional plane A—A corresponding to the representation of FIG. 2 has also been depicted. In the production stage represented, a plurality of fuse elements 5 are still connected to one another in the form of a bar, which has at predetermined points on an axis 10 parallel to the fusible conductor 1, at fixed distances d, holes 11 which pass through both ceramic layers 6 of the fuse element 5. The holes 11 are lined over their entire inner surfaces 12 with a conductive paste which is capable of cofiring and during sintering bonds in an electrically conducting manner with the fusible conductor 1. Perpendicularly with respect to the axis 10, a separating plane 13 runs through each of the holes 11. After a concluding, individually separating step by means of breaking, lasing or else sawing of the sintered arrangement, the halved inner surfaces 12 of each hole 11 form on opposite end faces of each fuse element 5 a fully functional external contact 14 which has good electrical conducting properties and can be soldered.

Before the arrangement described above has been put together and pressed, a strip 15 of a conductive paste, which is likewise capable of cofiring, is pressed on in the region of one hole 11 on the base layer 7, which is subsequently in direct contact with the fusible conductor 1. The hole 11 may be made in the arrangement in this region by punching, for example, even after pressing or during pressing. The strip 15 serves for a constant and as monotonous as possible current density distribution from the external contact 14 to the fusible conductor 1 in the interior the fuse element 5. The strip 15 consequently assumes the function of a terminal area. This ensures that, with good contact, a maximum of the current density is achieved only in the pressure-resistant interior of the fuse element 5, i.e. it can also only be triggered in the interior of the fuse element 5, and not in the region of its end faces or too close to the external contacts 14 of the fusible conductor 1.

Figure 4:
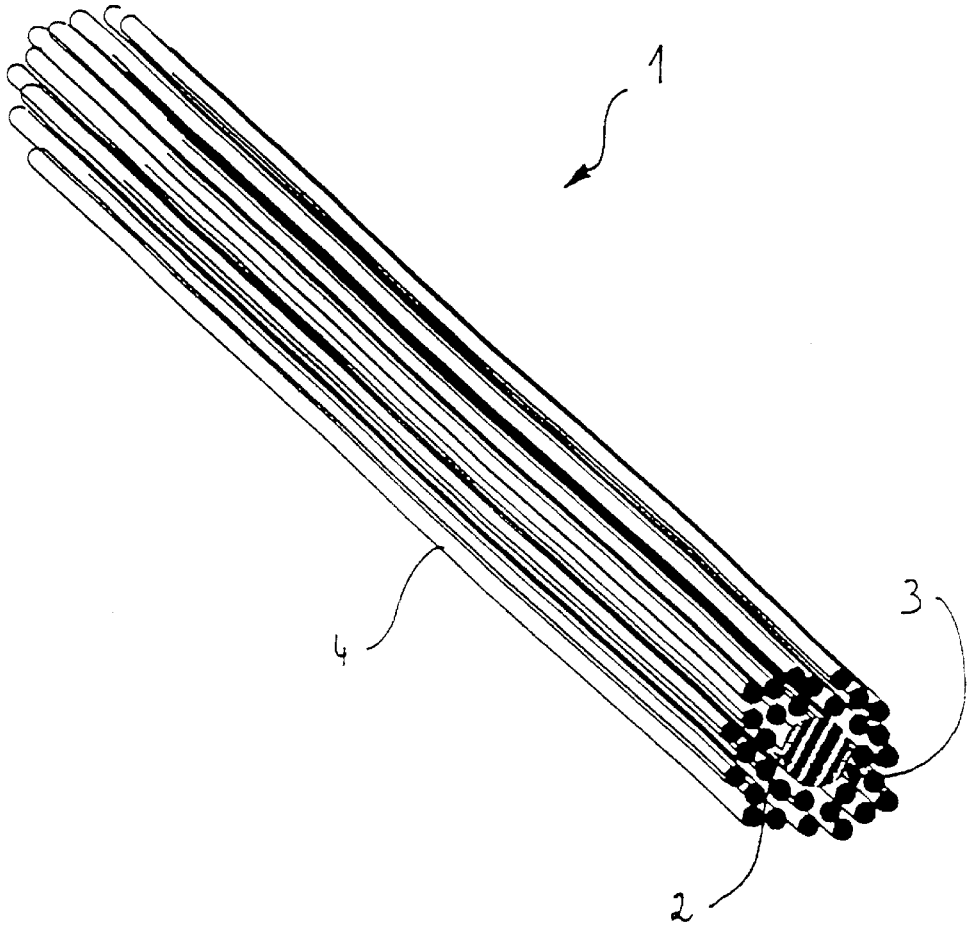
FIG. 4 shows a further embodiment of a fusible conductor.

FIG. 4 shows a further embodiment of a fusible conductor 1. In this embodiment, a smooth wire 2 forms the core 3, which is enclosed around its longitudinal axis by ceramic filaments 4. The filaments 4 consequently form a porous sheath around the wire 3. In this respect, methods of twisting are known, for example from the area of cable technology, in particular optical communications technology, for sheathing or handling sensitive materials and can also allow the production of a fusible conductor 1 as a prefabricated endless material in the case of the embodiment of FIG. 4.

The sheath of the fusible conductor 1 can also be chosen with a relatively large diameter. Then, the distance of an outer sheath surface from an arc at the switching-off instant is so great that chemical auxiliaries can also be used here for temporarily fixing the filaments, without the risk of carbon bridges forming or any retroactive effect on the wire material.

Figure 5:
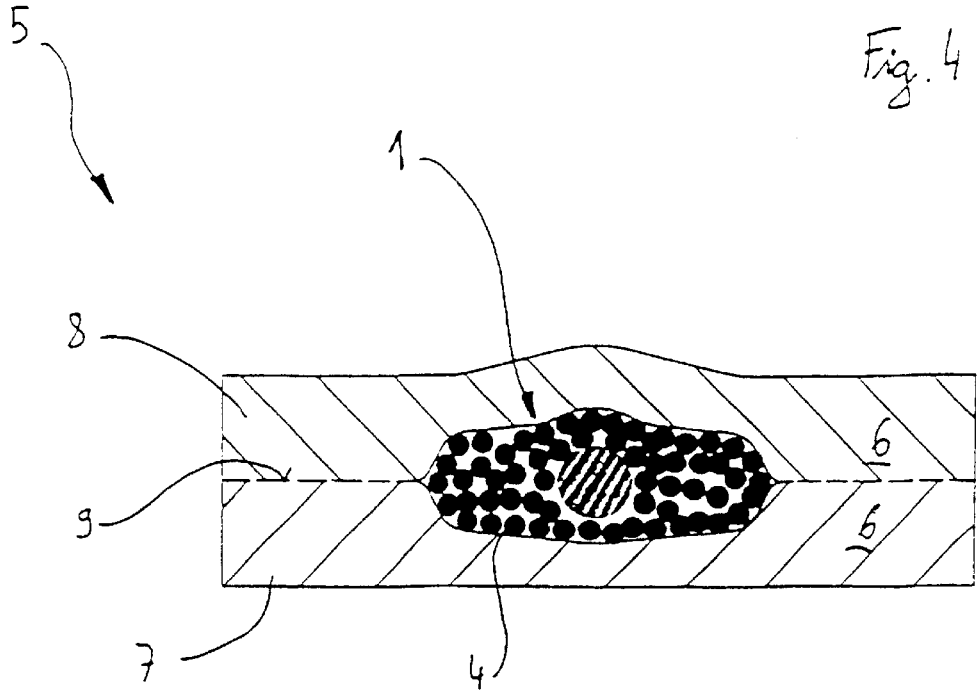
FIG. 5 shows a section through a fuse element according to the invention using the fusible conductor from FIG. 4.

A section through a fuse element 5 according to the invention, using the fusible conductor 1 from FIG. 4, is represented in FIG. 5. The arrangement essentially corresponds to that of FIG. 2, although the good adaptability of this second embodiment to cross-sectional changes during pressing between the ceramic layers 6 is also graphically emphasized.

In this embodiment, it is also easily possible to remove the ceramic sheath portion by portion from the filaments 4 or to provide sheath portions on the wire 2. The sheath of filaments 4 can thus be deliberately arranged only in the region of the hot spot, whereas towards the external contacts the wire 3 is enclosed in a gas-tight manner directly between the base layer 7 and the covering layer 8. For the actual electrical contacting of the wire 3, everything which has already been said in the description of FIG. 3 applies in principle.

What is claimed is:

1. An electrical fuse element comprising a) at least one fusible conductor having an electrically conductive component and an insulating, porous component; and b) a substantially ceramic housing which, in an unfired state, is closed around said at least one fusible conductor and includes at least one ceramic layer having at least one hole located proximate the at least one fusible conductor, said at least one hole being full of a conductive paste, said conductive paste being capable of cofiring and, after a sintering step, forming an electrical connection to the fusible conductor and an external contact.

2. The electrical fuse element of claim 1, wherein the insulating component comprises a plurality of ceramic filaments.

3. The electrical fuse element of claim 2, wherein said at least one fusible conductor is embedded in said plurality of ceramic filaments which surround said at least one fusible conductor in a substantially tubular manner.

4. The electrical fuse element of claim 3, wherein the ceramic filaments are flexibly connected to each other.

5. The electrical fuse element of claim 4, wherein said ceramic filaments are interwoven.

6. The electrical fuse element of claim 4, wherein said ceramic filaments are twisted together.

7. The electrical fuse element of claim 1, wherein said insulating component forms an elongated core and said electrically conductive component comprises a wire wound around said elongated core.

8. The electrical fuse element of claim 1, wherein said at least one ceramic layer comprises a ceramic covering layer having a hole and a ceramic base layer having a hole, one of said ceramic covering layer hole and said ceramic base layer hole being arranged to overlay the other of said ceramic covering layer hole and said ceramic base layer hole proximate the at least one fusible conductor for forming an external contact.

9. The electrical fuse element of claim 1, wherein the at least one fusible conductor is arranged in a defined relationship to a central axis of the electrical fuse element, said at least one ceramic layer comprising a base layer and a covering layer and wherein a conductive strip consisting of a conductive paste, capable of a cofiring, is disposed on at least one of said base and covering layers substantially perpendicularly with respect to said central axis.

10. The electrical fuse element of claim 9, wherein the holes within said ceramic base layer and said ceramic covering layer are plated through holes.

11. The electrical fuse of claim 1, wherein said at least one fusible conductor is arranged in a defined relationship along a central axis of said electrical fuse element and two holes are formed in said ceramic layer at a predetermined distance along said central axis, said fuse element having a length that is determined by said predetermined distance.

12. The electrical fuse element of claim 1, wherein said at least one ceramic layer consists of an unfired glass ceramic material.

13. The electrical fuse element of claim 1, wherein said at least one ceramic layer consists of green ceramic material having an endless strip shape or a sheet material shape.

14. An electrical fuse element comprising a) at least one fusible conductor having an electrically conductive elongated member and an insulating, porous component;

b) a substantially ceramic housing which, in the unfired state, is closed around said at least one fusible conductor and includes at least one ceramic layer having at least one hole located proximate the at least one fusible conductor and filled with a conductive paste, said conductive paste being capable of cofiring and, after a sintering step, forming an electrical connection to the at least one fusible conductor and an external contact;

c) a ceramic covering layer having a hole; and d) a ceramic base layer having a hole arranged such that the hole of said covering layer lies above the hole of the ceramic base layer in the region of the at least one fusible conductor for forming an external contact.

15. An electrical fuse element comprising:

a) at least one fusible conductor comprising an electrically conductive wire and a porous, insulating component comprising a plurality of ceramic filaments, said electrically conductive wire being surrounded by said plurality of ceramic filaments in a substantially tubular manner such that said electrically conductive wire is embedded within said plurality of filaments; and b) a substantially ceramic housing which, in an unfired state, is closed around said electrically conductive wire and includes at least one ceramic layer having at least one hole located in the region of the electrically conductive wire and filled with a conductive paste, said conductive paste being capable of cofiring and, after a sintering step, forming an electrical connection to the electrically conductive wire and an external contact.

* * * * *